United States Patent [19]

Hildebrand et al.

[11] 4,439,206

[45] Mar. 27, 1984

[54] DYEING PROCESS WITH REACTIVE DYES AND GLYCIDYL COMPOUND

[75] Inventors: Dietrich Hildebrand; Udo W. Hendricks, both of Odenthal, Fed. Rep. of Germany

[73] Assignee: Bayer Aktiengesellschaft, Leverkusen, Fed. Rep. of Germany

[21] Appl. No.: 439,099

[22] Filed: Nov. 3, 1982

[30] Foreign Application Priority Data

Nov. 27, 1981 [DE] Fed. Rep. of Germany ..... 3147153

[51] Int. Cl.[3] ..... D06P 1/64

[52] U.S. Cl. ..... 8/543; 8/531; 8/532; 8/533; 8/576; 8/584; 8/593; 8/917; 8/918; 8/924

[58] Field of Search ..... 8/576, 543, 584, 593, 8/531, 532, 533, 543, 570

[56] References Cited

U.S. PATENT DOCUMENTS

| | | | |
|---|---|---|---|
| 3,501,259 | 3/1970 | Long | 8/496 |
| 3,545,910 | 12/1970 | Ong | 8/532 |
| 3,673,558 | 6/1972 | Toepel et al. | 8/495 |
| 4,268,266 | 5/1981 | Hendricks et al. | 8/576 |
| 4,294,579 | 10/1981 | Hendricks et al. | 8/576 |

FOREIGN PATENT DOCUMENTS

| | | |
|---|---|---|
| 2922484 | 12/1980 | Fed. Rep. of Germany . |
| 1236882 | 6/1971 | United Kingdom . |

*Primary Examiner*—A. Lionel Clingman

*Attorney, Agent, or Firm*—Sprung, Horn, Kramer & Woods

[57] ABSTRACT

The present invention relates to a new dyeing process based on the exhaustion principle. It is characterized in that dyeing liquors are used which, in addition to the dyestuff or dyestuff mixture, contain one or more salts, at least one compound having a glycidyl radical and, if appropriate, further auxiliaries.

7 Claims, No Drawings

DYEING PROCESS WITH REACTIVE DYES AND GLYCIDYL COMPOUND

The present invention relates to a new dyeing process based on the exhaustion principle.

The process according to the invention is characterised in that dyeing liquors are used which, in addition to the dyestuff or a dyestuff mixture, contain one or more salts, at least one compound having a glycidyl radical and, if appropriate, further auxiliaries.

The process according to the invention is suitable, to a particular degree, for dyeing cellulose fibre materials and/or polyamide materials and fibre mixtures containing cellulose fibre materials and/or polyamide materials with reactive dyestuffs according to the exhaustion principle.

Possible salts for the process according to the invention are primarily salts having a neutral reaction, if appropriate mixed with salts having a weakly acidic or weakly alkaline reaction.

Possible compounds containing glycidyl radicals particularly suitable for the process according to the invention are compounds which contain glycidyl groups and have the formula $$Z[Q]_p \qquad \text{(I)}$$

wherein

Q denotes a radical of the formula

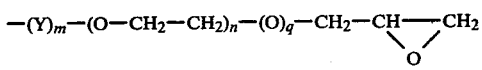

Z denotes a 1-4-valent aliphatic hydrocarbon radical which can be interrupted by S atoms, a cycloaliphatic hydrocarbon radical, a saturated heterocyclic radical or the groups

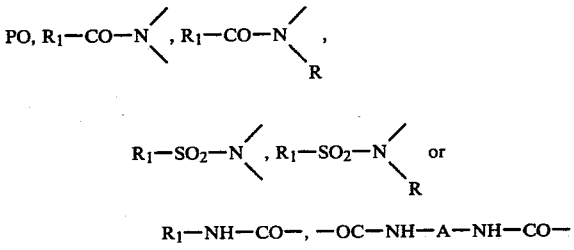

R denotes hydrogen or alkyl, $R_1$ denotes alkyl, cycloalkyl, aryl or aralkyl,

Y denotes a radical of the formula $$-CO-CH_2-CH_2-,\ -SO_2-CH_2-CH_2-\ \text{or}\ -CH_2-CH_2-$$

A denotes alkylene or arylene, m denotes 0 or 1, n denotes 0–10, q denotes 0 or 1 and p denotes 1–4.

In this formula, q represents zero only when m and n represent zero and the glycidyl radical is bonded to a heteroatom of Z.

When p represents 2–4, the substituents Q are bonded to various atoms of Z.

The bridge member Y is preferably bonded to a nitrogen atom of Z.

The aliphatic and cycloaliphatic hydrocarbon radicals are, in particular, optionally branched radicals having up to 8 C atoms.

Those aliphatic radicals Z and alkyl radicals R and $R_1$ are preferable which have 1–5 carbon atoms.

Preferable cycloaliphatic radicals Z and cycloalkyl radicals $R_1$ are the cyclopentyl and the cyclohexyl radical.

Aryl and aralkyl represent in particular phenyl and benzyl respectively.

A represents, for example, a $C_2$–$C_6$-alkylene or a phenylene radical.

Examples which may be mentioned of heterocyclic radicals Z are the 1,3,5-hexahydrotriazine radical or radicals of the formula

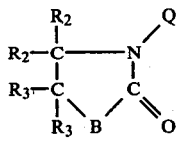

(II)

wherein $R_2$ represents hydrogen or, together, oxygen, $R_3$ represents hydrogen or methyl and B represents

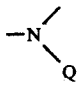

or $-CH_2-$, or the grouping

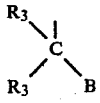

represents an o-phenylene radical.

Preferable compounds of the formula I are those of the formulae

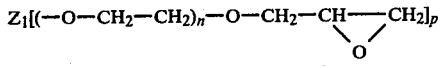

(III)

wherein $Z_1$ denotes a 1-4-valent aliphatic hydrocarbon radical having 1–5 carbon atoms and n and p have the abovementioned meaning,

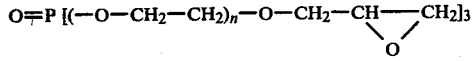

(IV)

wherein n has the abovementioned meaning and

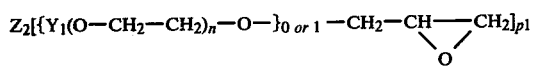

(V)

wherein
$Z_2$ denotes the 1,3,5-hexahydrotriazine radical or a radical of the formula II,
$Y_1$ denotes $—CO—CH_2CH_2$ or $—SO_2—CH_2—CH_2—$ and $p_1$ denotes 1-3,
n has the abovementioned meaning and the radical shown in square brackets is bonded to a nitrogen atom of $Z_2$.
Examples which may be mentioned of compounds I are:
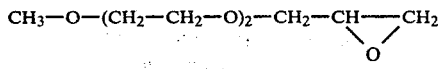
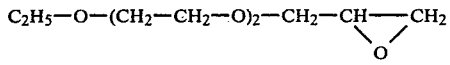
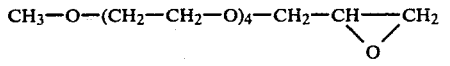
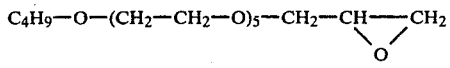
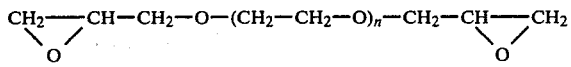
n = 0-8, in particular 1-6
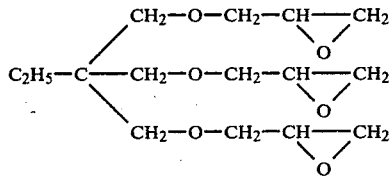
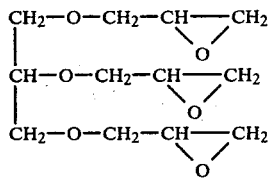
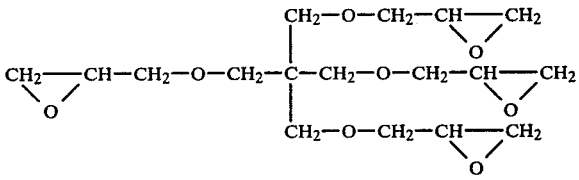
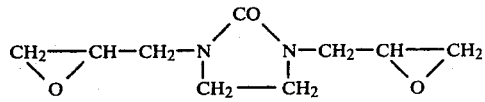
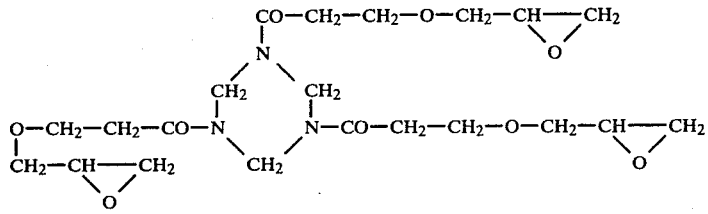
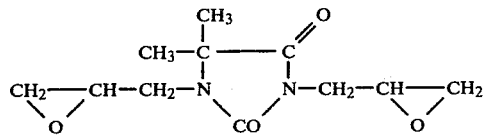

-continued

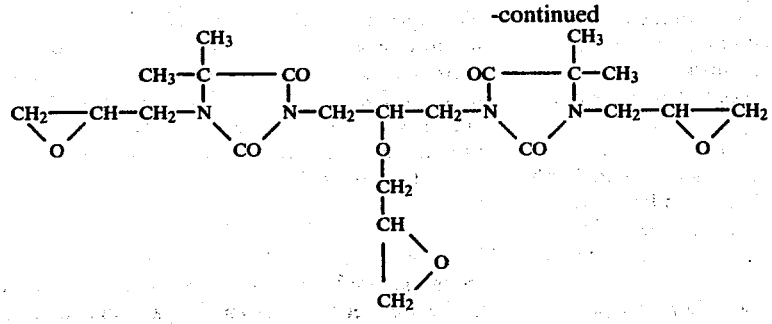

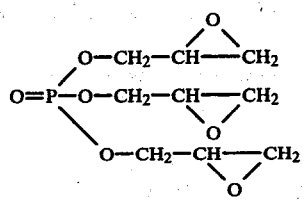

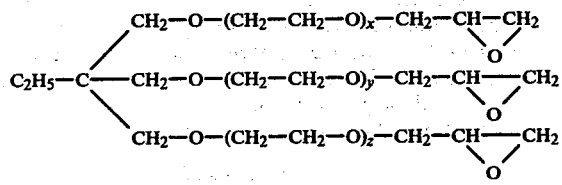

x,y,z = 1–10
x + y + z = 25

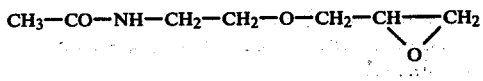

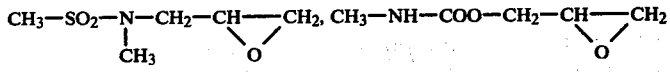

The following are also possible:

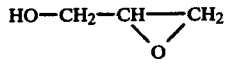

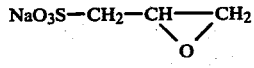

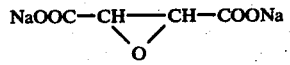

and, if the compounds having glycidyl groups are alcohols, their esters with acids, for example with phosphoric acid.

The amounts of compounds having glycidyl radical to be used in the process according to the invention depend on the depth of shade to be obtained and the liquor ratio.

In general, 1 to 20 g of glycidyl compound, preferably 3 to 6 g of glycidyl compound, are used per liter of dyeing liquor.

The following reactive dyestuff classes are preferably possible for use as dyestuffs suitable for the process according to the invention for dyeing cellulose: those organic dyestuffs from the series of the anthraquinone, azo, azo metal complex, formazan, oxazine and phthalocyanine series which have at least one fibrereactive group such as the sulphatoethylsulphonyl, monochlorotriazinyl, dichlorotriazinyl, dichloroquinoxalinyl, trichloropyrimidinyl, monofluorotriazinyl, 2,4-difluoro-5-chloropyrimidinyl, 2-fluoro-5-chloro-6-methylpyrimidinyl and 4-fluoro-5-chloropyrimidinyl group. A large number of reactive dyestuffs of the abovementioned structure have been described in the literature (compare on this point for example German Offenlegungsschrift No. 1,186,160, German Offenlegungsschrift No. 1,544,499, German Offenlegungsschrift No. 1,228,013, German Offenlegungsschrift No. 1,644,171, German Offenlegungsschrift 2,556,640, German Offenlegungsschrift No. 1,644,208, German Offenlegungsschrift No. 1,644,617, German Offenlegungsschrift No. 1,644,616 and also Venkataraman, The Chemistry of Synthetic Dyes, Volume VI, Reaction Dyes; Academic Press, New York, London 1972). Those reactive dyestuffs specified in the examples and also structurally related reactive dyestuffs are particularly preferably used in the process according to the invention. The parts indicated in the examples are in all cases parts by weight.

In dyeing mixed fabric of cellulose and other fibres, to dye the non-cellulose portion of the particular mixed fibre the dyestuffs customary for the corresponding fibre, such as, for example, disperse dyestuffs, are used in customary concentration ratios. As for the rest, here also reference is made to the illustrative embodiments.

As mentioned above, the process according to the invention is most suitable for the dyeing of cellulose fibres and of cellulose-containing fibres. Cellulose fibres which may be mentioned are cotton, rayon and viscose staple.

Fibres which may be mentioned as present in mixture with cellulose are polyester fibres and polyamide fibres.

The process according to the invention is also suitable for the dyeing of wool or of wool mixed with other fibres, such as, for example, acrylate, polyester or polyamide fibres.

The starting pH value and amount and type of auxiliaries to be added if appropriate must be selected with reference to the abovementioned materials to be dyed. Possible examples of such auxiliaries are levelling agents, dispersing agents, antioxidants, carrier substances and the like.

In the process according to the invention, possible salts having a neutral reaction are above all NaCl and $Na_2SO_4$.

Examples which can be mentioned of salts having a weakl acidic reaction and being particularly suitable for the process according to the invention are monosodium or monopotassium phosphate and monosodium or monopotassium sulphate.

Examples which may be mentioned of suitable salts having a weakly alkaline reaction are sodium or potassium bicarbonate, sodium acetate, disodium or dipotassium phosphate and tetrasodium pyrophosphate.

The amounts of salt to be used depend on the depth of shade and the dyeing temperature desired and on the liquor ratio and they can be determined in a simple manner by preliminary experiments.

The salts used in the process according to the invention can further be used on their own and/or mixed. Mixtures of 30 to 120 g/l, preferably 50–80 g/l, of a neutral salt such as sodium chloride or sodium sulphate with 0.2 to 4 g/l of a salt having a weakly alkaline or weakly acidic reaction have been found to be advantageous.

The starting pH value of the dye bath depends on the fabric to be dyed. To set the starting pH value desired, additions of weak acids, such as acetic acid, are suitable in addition to mixtures of salts having a weakly acidic and weakly alkaline reaction.

In dyeing cellulose fibres and/or polyamide fibres, a starting pH value of the dyeing liquor is preferably chosen which is between pH 5 and pH 8 (in particular between pH 6.5 to 7.5). The final pH value of the abovementioned dyeing liquors is then at pH 8 to pH 11.5, preferably at pH 9.5 to 10.5. In dyeing wool, a starting pH value is chosen which is between pH 2 and pH 5, the final pH value then being between pH 5 and pH 7. The glycidyl compound added produces with increasing temperature a continuous increase in pH value the profile of which increase depends on various factors, for example also on the reaction taking place between the reactive dyestuff and the cellulose fibre and on the type of glycidyl compound used.

In a certain variant of the process which is particularly suitable for mixed fibres, glycidyl compounds which, on being cleaved, liberate first alkali and then acid (for example esters of phosphoric acid and alcohols containing glycidyl groups, in which case the pH value of the dyeing liquor first increases slowly and thus favours dyeing of the cellulose or polyamide portion of the fibre, the pH value, due to the slowly liberated phosphoric acid, then finally again falling and favouring dyeing of the other part of the fibre (for example polyester) within the acid range) are added to the dyeing liquors used. In this last-mentioned variant, the pH range therefore increases from pH 5 to 8 to values of about pH 8–10 and then drops towards the end of the dyeing step without acid addition at temperatures of 80° to 130° C. to values of pH 5 to pH 7.

The process according to the invention is generally carried out in such a way that the starting temperatures are between 20° and 40° C. and the final temperatures are between 45° and 125° C. The process can advantageously also be carried out at a constant temperature, for example at 65°.

EXAMPLE 1

100 parts of knitted cotton goods are introduced into a commercial jet dyeing unit, which is charged with 700 parts of water at 25° C. and 70 parts of sodium chloride. Thereafter 10 parts of the compound of the formula

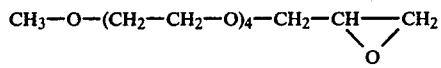

producing a pH of 6 to 7, and 2 parts of the dyestuff I are added, and the liquor is heated to 80° C. while the goods and liquor are thoroughly circulated. Dyeing is carried out for 1 hour at this temperature. The final pH value is 10.3. After the residual liquor has been dropped, the goods, in the customary manner, are rinsed cold and warm and soaped at the boil.

A level red dyeing is obtained.

EXAMPLE 2

100 parts of a mercerised cotton yarn are introduced in the form of cross-wound packages in a yarn dyeing apparatus into 1,000 parts of a liquor which consists of 90 parts of sodium chloride, 8 parts of a compound of the formula

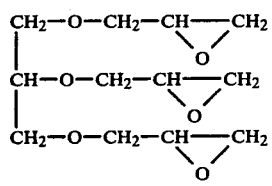

2 parts of the dyestuff II and 900 parts of water. The starting pH value of the liquor is 6.9. The liquor is heated to 95° C. at a heat-up rate of ½°/minute and maintained for 15 minutes at this temperature. The final pH of the liquor is 9.0. The exhausted residual liquor is then dropped, and the dyeing obtained is rinsed cold and warm and, as customary, boiled for 10 minutes with fresh water. A clear blue dyeing is obtained.

EXAMPLE 3

100 parts of a rayon cake are introduced in the form of twisted yarn packages in a yarn dyeing apparatus into 1,000 parts of a warmed liquor at 80° C. which contains 80.00 parts of sodium sulphate, 0.25 part of monosodium phosphate, 8.00 parts of the compound of the formula

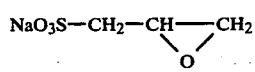

909.75 parts of water and 2 parts of the dyestuff III. The starting pH of the liquor is 5.5. The bath is raised in this sealed apparatus in the course of 1 hour to 110° C. and maintained at this temperature for 1 hour. The final pH is 8. A level well-penetrated yellow dyeing is obtained which, after the customary rinsing and soaping at the boil, has an excellent fastness level.

EXAMPLE 4

100 parts of a textile material consisting of 50 parts of viscose staple and 50 parts of polyester are treated in a winch with a warm liquor at 65° C. and consisting of 80 parts of sodium chloride, 3 parts of the compound of the formula

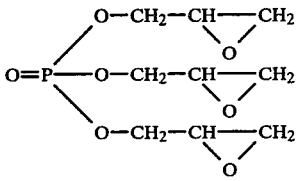

1 part of the dyestuff IV, 1 part of the dyestuff VI, 1 part of sodium dinaphthylmethanedisulphonate (dispersing agent), 1 part of sodium metanitrobenzenesulphonate (antioxidant), 2 parts of trichlorobenzene (carrier) and 1,200 parts of water.

The starting pH of the liquor is 7.5. The bath is warmed in the course of 60 minutes to 95° C., and the dyeing is carried out for 1 hour at this temperature. The pH value of the liquor slowly increases to pH 9.2 and then gradually drops to a value of 6.5.

After the customary rinsing and soaping at the boil, a red dyeing is obtained which has good fastness properties.

EXAMPLE 5

100 parts of mercerised cotton goods are treated in a jet dyeing machine with a warm liquor at 60° C. and consisting of 80 parts of sodium chloride, 0.5 part of sodium bicarbonate, 6 parts of the compound of the formula

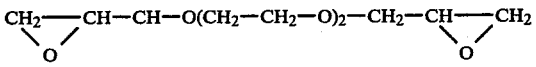

2 parts of the dyestuff V and 800 parts of water.

The starting pH value of the liquor is 8.2. Dyeing is carried out for 2 hours at 60° C. During this time the pH value increases slowly to 11.3. After the customary rinsing and soaping at the boil, a level, deep green dyeing is obtained which has good fastness properties.

EXAMPLE 6

100 parts of a chlorinated wool knitting yarn are introduced in a hank dyeing apparatus into 2,000 parts of a warm liquor at 40° C. and consisting of (a) 1 part of the dyestuff II
(b) 1 part of the dyestuff III
(c) 10 parts of sodium sulphate
(d) 4 parts of the compound of the formula

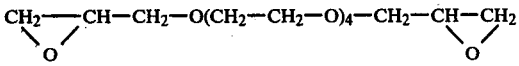

(e) 2 parts of the compound of the formula

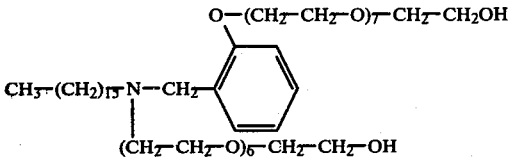

(levelling agent for reactive dyestuff)

(f) 2 parts of 30% strength acetic acid and 1,980 parts of water.

The bath is raised in the course of 1 hour to the boiling temperature, and dyeing is carried out for 1 hour at the boil. After the cold rinse and 15 minutes' aftertreatment with fresh water at 80°, the goods are acidified with ½ part of 60% strength acetic acid in 2,000 parts of liquor. A level green dyeing is obtained which has good fastness properties.

If the dyeing is carried out in the same way as described but 3 parts of the compound of the formula

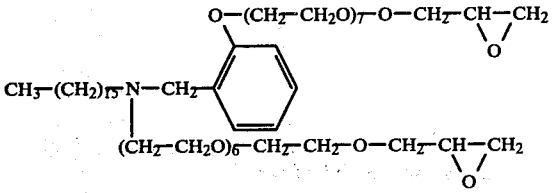

are used instead of 4 parts of the compound (d) and 2 parts of the compound (e), a level dyeing is likewise obtained which has good fastness properties.

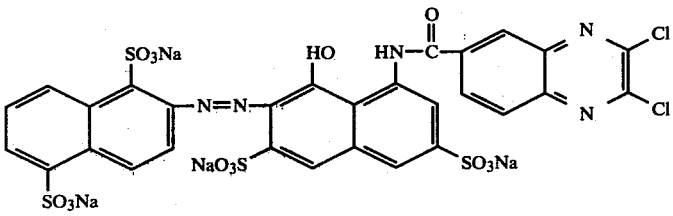

I

-continued

II

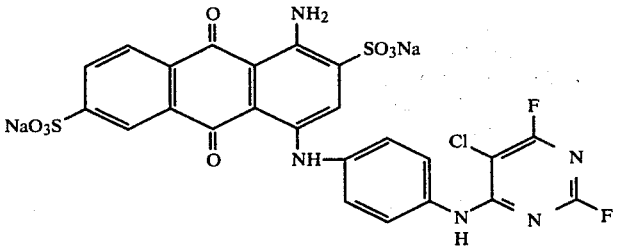

III

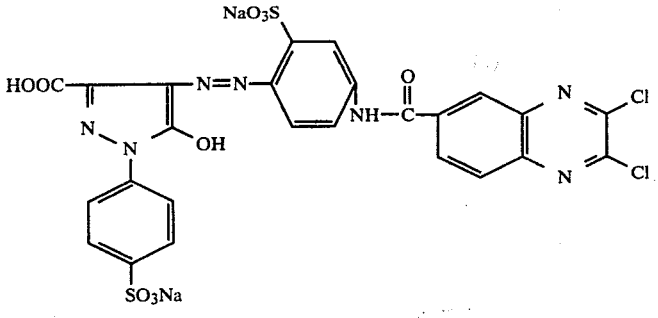

IV

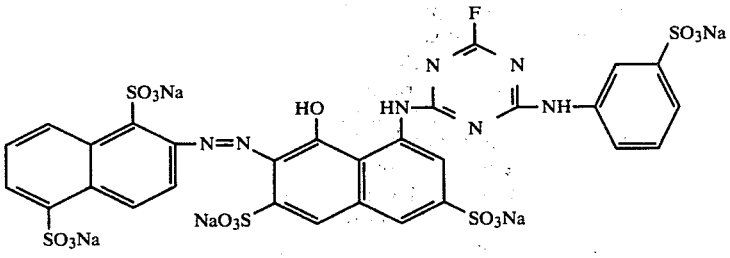

V

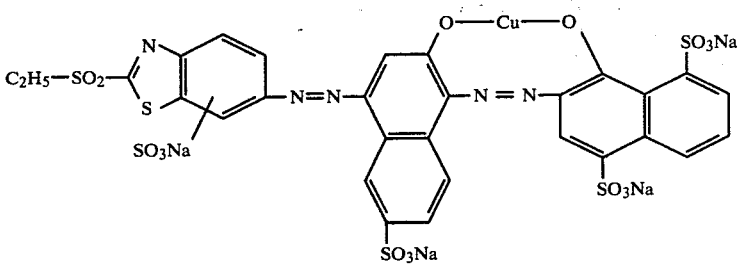

VI

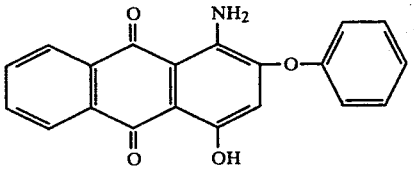

We claim:

1. Process for dyeing fibres by the exhaustion principle, characterized in that a reactive dyeing liquor is used which, in addition to the reactive dyestuff or the reactive dyestuff mixture, contains one or more salts, at least one compound having a glycidyl radical, and, if appropriate further auxiliaries, further characterized in that exhaustion liquors are used which contain a compound of the general formula $$Z[Q]_p$$

wherein

Q denotes a radical of the formula $$-(Y)_m-(O-CH_2-CH_2)_n-(O)_q-CH_2-\underset{\diagdown O \diagup}{CH}-CH_2$$

Z denotes a 1-4-valent aliphatic hydrocarbon radical which can be interrupted by S atoms, a cycloaliphatic hydrocarbon radical, a saturated heterocyclic radical or the groups $$-PO,\ R_1-CO-N\ ,\ R_1-CO-N\ ,$$

-continued

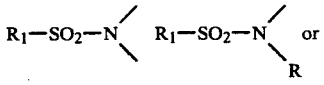

$R_1-NH-CO-$, $-OCNH-A-NH-CO-$,

R denotes hydrogen or alkyl, $R_1$ denotes alkyl, cycloalkyl, aryl or aralkyl,

Y denotes a radical of the formula $-CO-CH_2-CH_2-$, $-SO_2-CH_2-CH_2-$ or $-CH_2-CH_2-$ A denotes alkylene or arylene, m denotes 0 or 1, n denotes 0–10, q denotes 0 or 1 and p denotes 1–4.

2. Process according to claim 1, characterised in that exhaustion liquors are used which contain a compound of the general formula

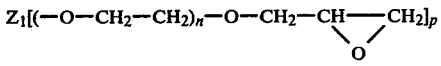

wherein $Z_1$ denotes a 1-4-valent aliphatic hydrocarbon radical having 1–5 carbon atoms and n and p have the meaning of claim 1.

3. Process according to claim 1, characterised in that dyeing liquors are used which contain NaCl or $Na_2SO_4$.

4. Process according to claim 1, characterised in that dyeing liquors are used which, in addition to NaCl or $Na_2SO_4$, contain, a salt or salt mixture from the series comprising monosodium or disodium phosphate, monopotassium or dipotassium phosphate, sodium or potassium acetate, sodium or potassium hydrogen sulphate or sodium borate.

5. Process according to claim 1, characterised in that the dyeing liquors used have a starting pH value of 5 to 8 and a final pH value of 8 to 11.5.

6. Process according to claim 1, characterised in that the dyeing liquors used have a starting temperature of 20° to 40° C. and a final temperature of 45° to 120° C.

7. Process according to claim 1, characterised in that the dyeing liquors used have a starting pH value of 5 to 8, then pass with increasing temperature to a higher pH value of 8 to 10 and then, without the addition of acid, on prolonged dwelling at temperatures of 80° to 130° C. assume a final pH value of 5 to 8.

* * * * *